US009737126B1

(12) United States Patent
Fishman

(10) Patent No.: US 9,737,126 B1
(45) Date of Patent: Aug. 22, 2017

(54) COMBINATION DISPENSER AND APPLICATOR

(71) Applicant: Yoram Fishman, Riverside, CA (US)

(72) Inventor: Yoram Fishman, Riverside, CA (US)

( * ) Notice: Subject to any disclaimer, the term of this patent is extended or adjusted under 35 U.S.C. 154(b) by 107 days.

(21) Appl. No.: 14/607,672

(22) Filed: Jan. 28, 2015

(51) Int. Cl.
*A45D 34/04* (2006.01)

(52) U.S. Cl.
CPC ..... *A45D 34/042* (2013.01)

(58) Field of Classification Search
CPC A46B 11/0017; A45D 34/042; A45D 40/262; A45D 2200/057; B65D 83/285
USPC ..... 401/190
See application file for complete search history.

(56) References Cited

U.S. PATENT DOCUMENTS

| | | | | |
|---|---|---|---|---|
| 3,073,319 | A | 1/1963 | Sperber | |
| 3,164,856 | A | 1/1965 | Samaras et al. | |
| 3,223,289 | A | 12/1965 | Bouet | |
| 3,228,057 | A | 1/1966 | Parrish | |
| 3,411,853 | A | 11/1968 | Hoff | |
| 3,731,854 | A * | 5/1973 | Casey | B65D 83/62 222/386.5 |
| 3,938,706 | A | 2/1976 | Cohen | |
| 3,981,597 | A * | 9/1976 | Cohn | A46B 11/0017 401/190 |
| 4,572,689 | A | 2/1986 | Chernack | |
| 4,789,261 | A * | 12/1988 | Iwase | A45D 34/042 401/190 |
| 4,964,540 | A | 10/1990 | Katz | |
| 5,115,944 | A | 5/1992 | Nikolich | |
| 5,477,985 | A | 12/1995 | Gueret | |
| 5,908,257 | A | 6/1999 | Martin | |
| 6,056,470 | A * | 5/2000 | Nehashi | A45D 34/042 401/279 |
| 6,530,709 | B1 | 3/2003 | Washington | |
| 2004/0195377 | A1 | 10/2004 | Williams | |
| 2008/0075525 | A1 | 3/2008 | Lewis | |
| 2013/0345647 | A1 | 12/2013 | Har-Shai | |

FOREIGN PATENT DOCUMENTS

| | | | | |
|---|---|---|---|---|
| EP | 0260528 | | 3/1988 | |
| EP | 307253 | | 3/1989 | |
| JP | 08-071460 | A * | 3/1996 | B65D 83/285 |

OTHER PUBLICATIONS

Machine Translation of JP08-071460 A; translated May 11, 2017.*

* cited by examiner

*Primary Examiner* — Jennifer C Chiang
*Assistant Examiner* — Bradley Oliver
(74) *Attorney, Agent, or Firm* — Eric Karich; Karich & Associates

(57) ABSTRACT

A combination dispenser and applicator has a dispenser body for mounting the dispenser body over a valve of a container of nail polish. The dispenser body has a brush receiver that receives the nail polish from the valve of the container. A disposable applicator brush, not including a valve, but with bristles adjacent a distal end, is shaped to removably engage the brush receiver. The disposable applicator brushes are inexpensive and disposable, and may be readily changed during use of the combination, so that one of the brushes is not used on multiple persons, thereby enabling a more hygienic method of applying nail polish.

14 Claims, 3 Drawing Sheets

COMBINATION DISPENSER AND APPLICATOR

BACKGROUND OF THE INVENTION

Field of the Invention

This invention relates generally to applicators for applying nail polish, and more particularly to a combination dispenser and applicator that utilizes disposable brushes that enable a user to quickly, easily, and inexpensively change brushes between uses.

Description of Related Art

The prior art also teaches various dispensing systems for dispensing nail polish and similar products. The prior art has failed to teach, however, a dispensing and applying system that includes a truly inexpensive and replaceable applicator brush that enables the frequent replacement of the applicator brushes between different persons, and/or between painting different parts of the person (e.g., toenail and fingernails).

Parrish, U.S. Pat. No. 3,228,057, teaches a combination applicator and dispenser brush that is generally similar to the present invention, which includes a pressurized vessel for containing liquid that is transmitted to a brush-mounting body via a through-delivery passageway. The vessel does not use bag-on-valve technology, and instead contains a propellant, which is potentially flammable, along with the liquid. The passage way is controlled by a valve and serves as the means of actuating the device. The bristles are integral with the valve actuator, so they are not readily disposable, without replacing the more expensive valve assembly as well, which is commercially impractical because of the increased expense. The brush is meant to be re-usable, and not disposable.

The present invention not only uses bag-on-valve technology, it also uses disposable applicator brushes that do not include any valves. The extremely simplified construction of the applicator brushes used in the present invention makes them very inexpensive, and therefore readily disposable.

Lewis, U.S. 2008/0075525, teaches a nail polish applicator that includes an elongate tubular housing including a reservoir for holding the nail polish, and an applicator that includes bristles for spreading the nail polish. While the bristles are shown integrally formed with the applicator, and they are not removable. The Lewis device also does not teach a bag-on-valve construction, and requires a manual dispensing slide to force the nail polish from the applicator.

Washington, U.S. Pat. No. 6,530,709, teaches an elongate nail polish applicator that is pen-shaped for easy use. The applicator includes a nail polish reservoir, a brush having bristles for spreading the nail polish, and a discharge mechanism for forcing the nail polish out of the applicator onto the bristles. The brush is retractable, but is not designed to be quickly and easily removed and replaced.

Katz, U.S. Pat. No. 4,964,540, describes a pressurized fluid dispenser of the kind used for dispensing a fluid by applying pressure on a container. The dispenser includes a tubular pleated bag that contains the fluid, and an elastomeric container that maintains pressure on the tubular pleated bag. A valve closes the tubular pleated bag to maintain the fluid in the tubular pleated bag until it is to be dispensed.

Hoff, U.S. Pat. No. 3,411,853, describes a disposable nail polish applicator that includes two telescopically connected elongated tubular members as its major components. One of these members is adapted to enclose a capsule wherein a determined volume of nail polish is hermetically sealed, and has an applicator brush assembly permanently secured thereto. The other member incorporates a means for piercing the capsule to emit the nail polish for flow onto the bristles of the brush assembly when desired. Both tubular members and the capsule are transparent, so that the actual color and shade of the nail polish is visible.

The above-described references are hereby incorporated by reference in full. None of the prior art references teaches a device that meets the requirements described herein to achieve the goals described below. The present invention fulfills the above-described needs, and provides further advantages as described in the following summary.

SUMMARY OF THE INVENTION

The present invention teaches certain benefits in construction and use which give rise to the objectives described below.

The present invention provides a combination dispenser and applicator for dispensing nail polish using disposable applicator brushes. The combination may include a container for containing the nail polish under pressure, the container having a valve for releasing the nail polish when actuated. The combination includes a dispenser body having a mounting structure for mounting the dispenser body over the valve, and provides a brush receiver that receives the nail polish from the valve of the container. A disposable applicator brush has bristles adjacent a distal end, is shaped to removably engage the brush receiver; however, the disposable applicator brush is of simply disposable construction, and does not include a valve. The disposable applicator brushes are inexpensive and disposable, and may be readily changed during use of the combination, so that one of the brushes is not used on multiple persons, thereby enabling a more hygienic method of applying nail polish.

A primary objective of the present invention is to provide a combination dispenser and applicator having advantages not taught by the prior art.

Another objective is to provide a combination dispenser and applicator that utilizes disposable brushes that enable a user to quickly, easily, and inexpensively change brushes between uses.

Another objective is to provide a combination dispenser and applicator that enables more hygienic practices in the application of nail polish, and particularly in changing applicator brushes between users, and between painting a person's toenails and fingernails.

A further objective is to provide a combination dispenser and applicator that uses inexpensive brushes, so that it is inexpensive to change brushes between users.

A further objective is to provide a combination dispenser and applicator that contains the nail polish within a flexible bag so that the nail polish maintains an optimum viscosity and does not dry out over time.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a combination dispenser and applicator 10 for dispensing nail polish 12. As discussed in greater detail below, the combination dispenser and applicator 10 utilizes disposable applicator brushes 100 that enable a user to quickly, easily, and inexpensively change brushes between uses. The combination dispenser and applicator 10 (hereinafter "the combination") enables more hygienic practices in the application of the nail polish 12, and particularly in changing the disposable applicator brush 100 between users, and between painting a person's toenails and fingernails.

Figure 1:
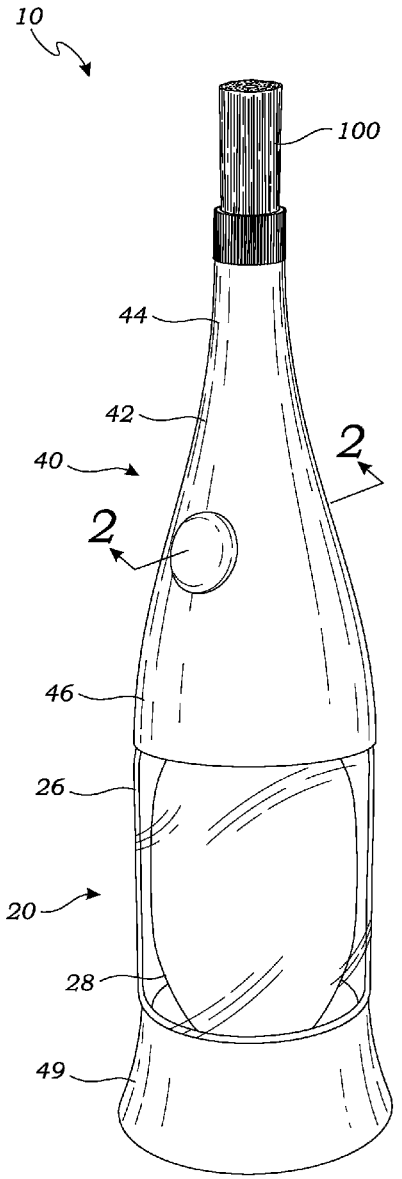
FIG. 1 is a perspective view of a combination dispenser and applicator for dispensing nail polish, according to one embodiment of the present invention.

FIG. 1 is a perspective view of one embodiment of the combination 10. As shown in FIG. 1, the combination 10 includes a container 20 that contains the nail polish (referred to with reference number 12, and shown in FIG. 4), and a dispenser body 40 that mounts onto the container 20 for dispensing the nail polish. The disposable applicator brush can be removably mounted onto the dispenser body 40 for application of the nail polish, and then removed and replaced as needed.

In the embodiment of FIG. 1, the container 20 is of a type known as a "bag on valve," that includes a rigid outer housing 26, and a flexible bag 28 positioned within an interior chamber 30 of the rigid outer housing 26. The rigid outer housing 26 and the flexible bag 28 may be any shape, size, and design that may be desired by one skilled in the art. The rigid outer housing 26 and the flexible bag 28 of this embodiment are both transparent, so that the user can see the color of the nail polish, and how much of the nail polish remains. The construction of the container 20 is described in greater detail below.

In this embodiment, the dispenser body 40 is mounted on top of the container 20, and the dispenser body 40 includes a top portion 44 and a bottom portion 46. A base 49 may be provided to support the container 20 in an upright orientation. The base 49 of the present embodiment is separate from the container 20, and lockingly engages the container 20 to support the container 20 in the upright orientation. The construction of the container 20 and the dispenser body 40 are further discussed in greater detail below.

Figure 2:
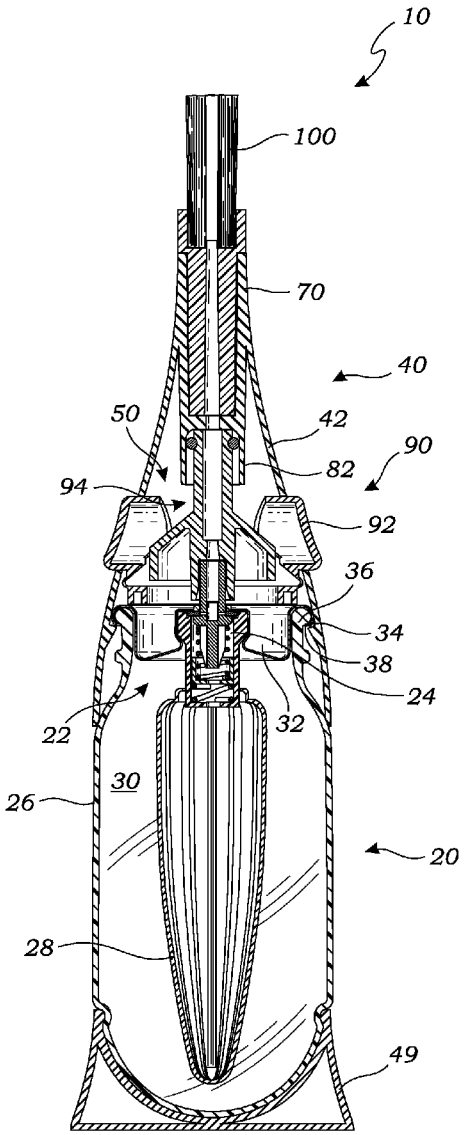
FIG. 2 is a sectional view thereof taken along line 2-2 in FIG. 1, illustrating the combination dispenser and applicator empty of nail polish, and in a non-dispensing configuration.

FIG. 2 is a sectional view thereof taken along line 2-2 in FIG. 1, illustrating the combination 10 empty of nail polish, and in a non-dispensing configuration. As shown in FIGS. 1-2, the container 20 includes a valve 24 for selectively releasing the nail polish when desired for application to a person's nails. The container 20 has an opening 22 that is covered with the valve 24 operably mounted over the opening 22 for selectively releasing the nail polish from the container 20 when actuated. In the present embodiment, the flexible bag 28 of the container 20 is operably attached to the valve 24 that is operably mounted within a sealing cap 32 that includes a perimeter 34 that is crimped against a rim 36 around the opening 22 of the rigid outer housing 26, in this case around an outer edge 38 of the rim 36 (i.e., the perimeter 34 is crimped inwardly against the outer edge 38), thereby sealing the rigid outer housing 26. The rigid outer housing 26 may be filled at some point in the process with a pressurized gas, such as nitrogen. Later, when the flexible bag 28 is filled, the contents of the flexible bag 28 will be under pressure by virtue of the pressure within the rigid outer housing 26 (which includes the pressure of the pressurized gas, plus the added pressure from the contents of the flexible bag 28).

While one embodiment of the container 20 is illustrated, those skilled in the art may devise alternative forms of containers 20 for dispensing the nail polish (e.g., a container that is pressurized with a propellant, such as in Parrish, U.S. Pat. No. 3,228,057, and such alternatives should be considered within the scope of the present invention, except to the extent expressly limited in the claims of this document.

Figure 3:
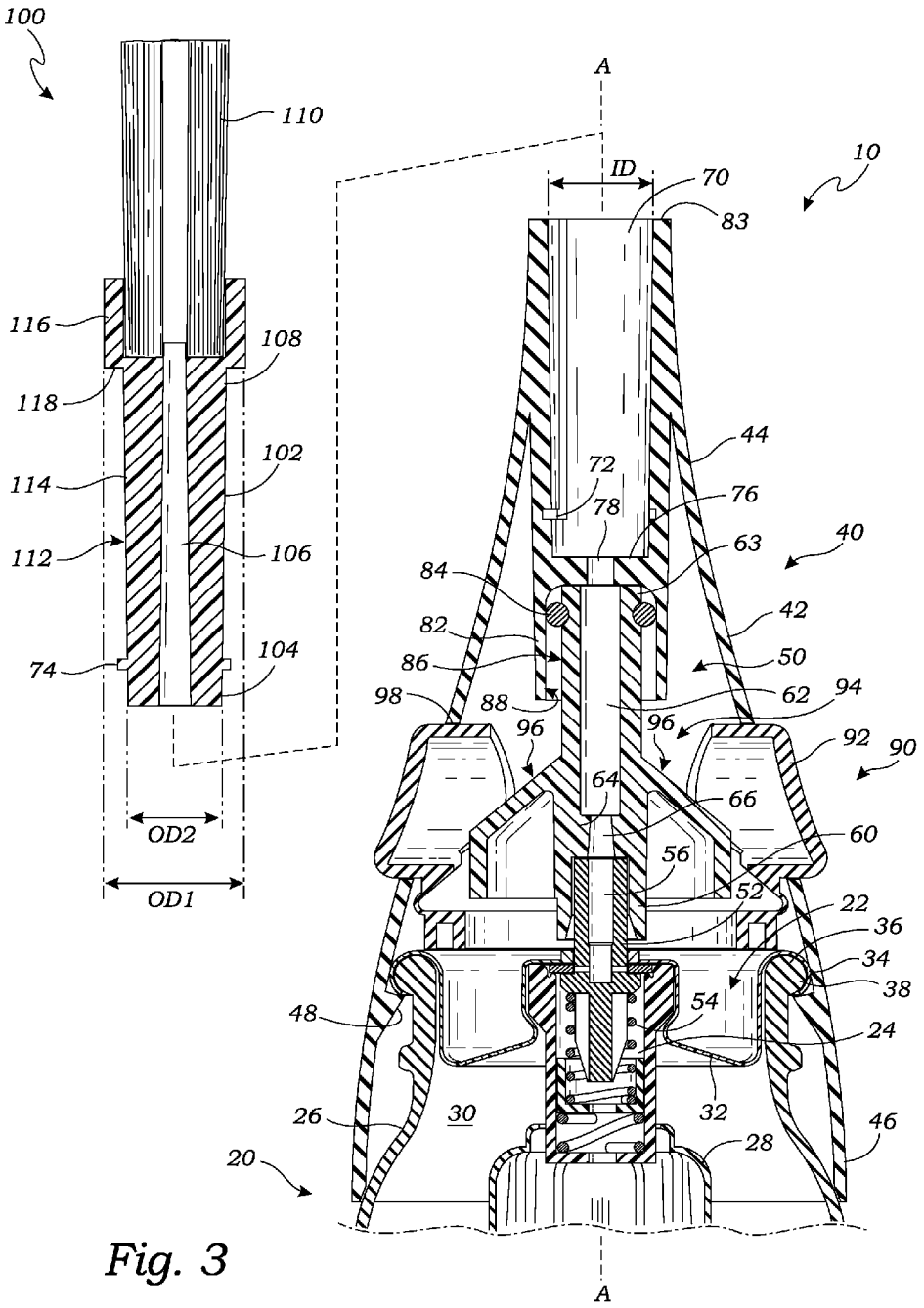
FIG. 3 is a close up of a dispensing mechanism of the combination dispenser and applicator from FIG. 2.

FIG. 3 is a close up of the dispenser body 40 of the combination 10 of FIG. 2. As shown in FIGS. 1-3, the dispenser body 40 also includes and houses a dispenser mechanism 50 that functions to dispense the nail polish from the container 20. In the present embodiment, the dispenser body 40 may include an outer housing 42, which in this embodiment is generally conical in shape, and may be constructed of any suitable housing material (e.g., plastic, metal, or any other material known in the art for this purpose). The dispenser body 40 includes a mounting structure 48 for mounting the dispenser body 40 onto the container 20 over the valve 24. In this embodiment, the mounting structure 48 includes an inwardly projecting annular ring that frictionally engages a rim 36 of the container 20 to removably lock the dispenser body 40 over the container 20. Other locking features or members known in the art may be used (e.g., a threaded connection, an adhesive layer, male/female engagement features, and others known in the art), and these alternative should be considered within the scope of the present invention, except to the extent expressly limited in the claims of this document.

As shown in FIG. 3, the valve 24 of the container 20 may include an upwardly extending dispensing tube 52 that is biased upwardly by a spring 54. A duct 56 formed in the upwardly extending dispensing tube 52 dispenses the nail polish from the container 20 when the bias of the spring 54 is overcome and the upwardly extending dispensing tube 52 is pushed downwardly. A similar valve is shown in Davideit et al., U.S. Pat. No. 8,292,121, which is hereby incorporated by reference.

As best shown in FIG. 3, the dispenser mechanism 50 may be housed in the dispenser body 40, and includes various components for dispensing the nail polish. In this embodiment, the dispenser mechanism 50 includes a valve receiver 60, a brush receiver 70, and a valve actuation mechanism 90 for actuating the valve 24.

The valve receiver 60 operatively engages the valve 24 and directs the nail polish into a dispenser conduit 62. In this embodiment, the valve receiver 60 is generally tubular in construction, and fits around the upwardly extending dispensing tube 52 of the valve 24 of the container 20. A dispenser conduit 62 extends upwardly from the valve receiver 60 for transporting the nail polish from the upwardly extending dispensing tube 52 to the brush receiver 70.

As shown in FIG. 3, the dispenser conduit 62 may be separated from the valve receiver 60 by a spacer wall 64 that includes a hole 66 therethrough for transmitting the nail polish. The upwardly extending dispensing tube 52 may abut the spacer wall 64, so that downward pressure on the valve receiver 60 depresses the upwardly extending dispensing tube 52 of the valve 24 and moves the valve 24 to an open position against the bias of a valve spring 54 that biases the valve 24 towards a closed position.

As shown in FIG. 3, the brush receiver 70 is shaped to receive the disposable applicator brush 100, and also receive the nail polish from the dispenser conduit 62 such that it flows into the disposable applicator brush 100. In this embodiment, the brush receiver 70 is formed in an upper portion of the dispenser body 40, and includes a chamber, bore, or similar structure shaped to receive the disposable applicator brush 100.

Figure 4:
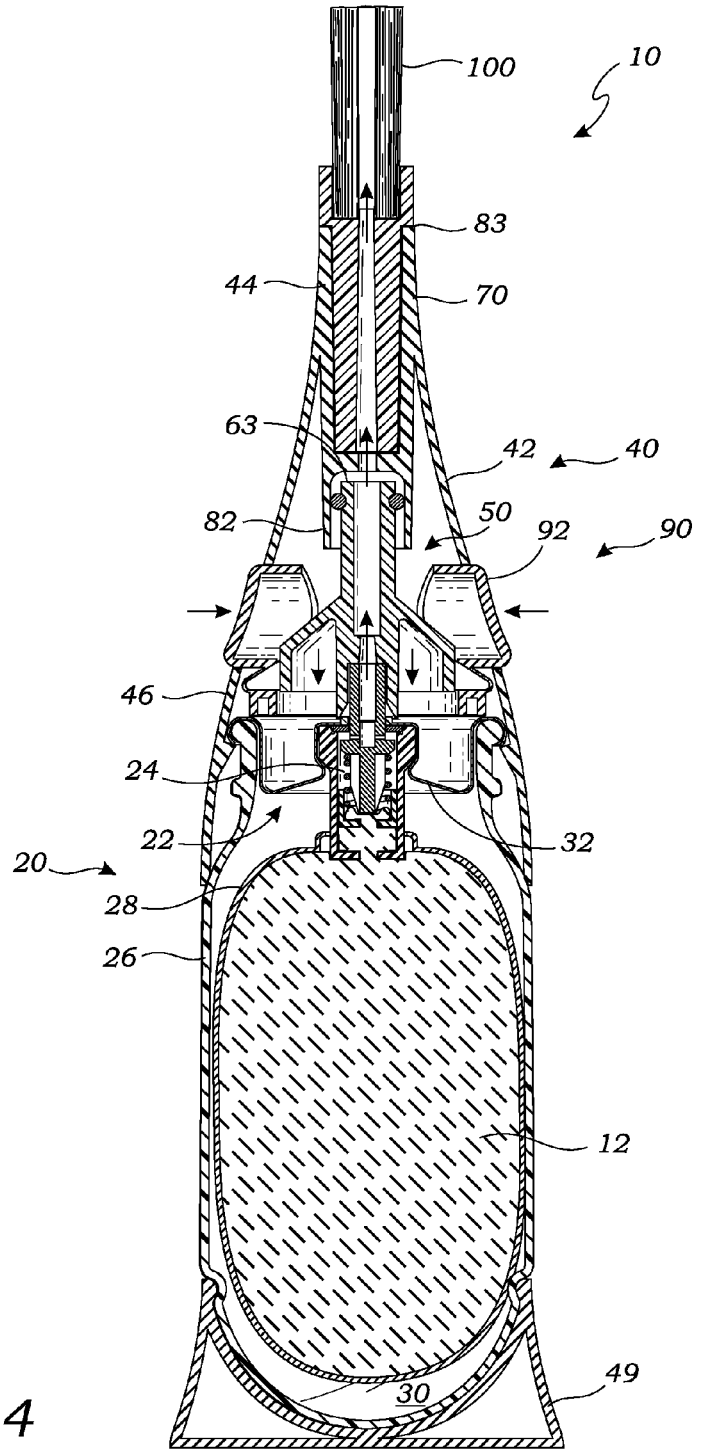
FIG. 4 is a sectional view similar to FIG. 2, although illustrating the combination dispenser and applicator full of nail polish, and being actuated to a dispensing configuration.

The brush receiver 70 may further include a locking feature 72 that interlocks with a mating feature 74 of the disposable applicator brush 100. In this embodiment, the locking feature 72 includes slots and the mating feature 74 includes posts that extend outwardly from the disposable applicator brush 100. The posts engage the slots in a construction that is generally known in the art. Alternative features may also be utilized, such as the inverse of the above-described construction, mating threads, or any other interlocking features that are known to those skilled in the art. Alternatively, the disposable applicator brush 100 may simply frictionally fit into the brush receiver 70, as shown in FIGS. 2 and 4, and rely on friction to maintain the engagement until the disposable applicator brush 100 is pulled from the brush receiver 70.

In this embodiment, the brush receiver 70 and the conduit receiver 82 are separated by a separator wall 76 that includes an aperture 78 therethrough for transmitting the nail polish into the disposable applicator brush 100. An end 63 of the dispenser conduit 62 engages a conduit receiver 82 formed beneath the brush receiver 70. The conduit receiver 82 may be in the form of a bore or open chamber, as illustrated, or in another structure that similarly receives the end 63 of the dispenser conduit 62.

In this embodiment, an O-ring 84 that fits around an outer surface 86 of the dispenser conduit 62 and abuts an inner surface 88 of the conduit receiver 82 so that the dispenser conduit 62 can move up and down in relation to the conduit receiver 82 and the dispenser body 40, without allowing the nail polish to leak from between the dispenser conduit 62 and the conduit receiver 82. This movement is used, in the current embodiment, as part of the valve actuation mechanism 90, as discussed in greater detail below. In other embodiments that do not utilize this valve actuation mechanism 90, the above-describes structure may not be required.

In the embodiment of FIG. 3, the valve actuation mechanism 90 includes at least one button 92, in this case a pair of buttons 92, and an actuation structure 94 integrally formed with the valve receiver 60. In this embodiment, the actuation structure 94 includes an inclined outer surface 96 that is integrally formed with the valve receiver 60. The inclined surface 96, in this case part of a generally conical structure, is inclined relative to an axis A of the valve receiver 60. In this embodiment, the inclined surface 96 is inclined about 45 degrees, with the term "about" being defined to mean +/−10%), although alternative angles may be used, as long as it is able to impart movement as described herein. The pair of buttons 92 each extend through an opening 98 in the dispenser body 40 and abut the inclined outer surface 96 such that pressing the buttons 92 pushes the actuation structure 94 downwardly and actuates the valve 24.

While one form of actuation structure 94 is illustrated, those skilled in the art may devise alternative structures for actuating the valve 24 and dispensing the nail polish, and such alternatives should be considered within the scope of the present invention, except to the extent expressly limited in the claims of this document.

In the embodiment of FIG. 3, the disposable applicator brush 100 has a tubular base 102 that forms a proximal end 104, a brush conduit 106, and a distal end 108, the brush conduit 106 being unobstructed and not including a valve. The disposable applicator brush 100 further includes a plurality of bristles 110 adjacent the distal end 108 of the brush conduit 106. The tubular base 102 has an external surface 112 that is shaped to removably engage the brush receiver 70 of the dispenser body 40 so that the nail polish from the dispenser conduit 62 flows through the brush conduit 106, and into the bristles 110 of the disposable applicator brush 100.

The tubular base 102 of the disposable applicator brush 100 may include a lower annular portion 114 and an upper annular portion 116, and the upper annular portion 116 has an outer diameter OD1 that is larger than an outer diameter OD2 of the lower annular portion 114. The outer diameter OD2 of the lower annular portion 114 is smaller than an inner diameter ID of the brush receiver 70, so that the lower annular portion 114 may slide into the brush receiver 70, preferably in a snug, frictional engagement. Furthermore, the outer diameter OD1 of the upper annular portion 116 of the tubular base 102 may be greater than the inner diameter ID of the brush receiver 70, so that the end 83 of the brush receiver 70 abuts a step 118 in the tubular base 102 between the lower annular portion 114 and the upper annular portion 116. In this position, the brush conduit 106 is adjacent and coaxially aligned with the aperture 78 of the separator wall 76 so that the nail polish is effectively directed into the disposable applicator brush 100.

For purposes of this application, the term "nail polish" is hereby defined to include any form of nail polish, nail lacquer, gloss, clear coat, gel, conditioner, or other liquid that a user may want to apply to finger nails or toe nails of a person or animal.

FIG. 4 is a sectional view similar to FIG. 2, although illustrating the combination 10 full of the nail polish 12, and being actuated to a dispensing configuration. As illustrated in FIG. 4, once the buttons 92 are pressed together (or the combination 10 is otherwise actuated), the dispenser mechanism 50 is moved downwardly to depress the valve 24, and release the nail polish 12 from the container 20. The nail polish 12 flows upwardly through the dispenser mechanism 50 and into the disposable applicator brush 100. The bristles 110 of the disposable applicator brush 100 are used to apply the nail polish 12 to the nails of the person.

As shown in FIG. 4, the nail polish 12 remains within the flexible bag 28, and is not exposed to air until it is dispensed. This enables the nail polish 12 to maintain optimum viscosity and not dry out over time. The "bag on valve" technology enables the combination 10 to exclude propellants, which may be flammable.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A combination dispenser and applicator for dispensing nail polish from a container that contains the nail polish under pressure, the container having an opening, and a valve operably mounted over the opening for selectively releasing the nail polish from the container when actuated, the combination comprising:

a dispenser body having a mounting structure for mounting the dispenser body over the valve;

a valve receiver housed in the dispenser body that operatively engages the valve and directs the nail polish into a dispenser conduit;

a valve actuation mechanism for actuating the valve;

a brush receiver formed adjacent an end of the dispenser conduit;

a disposable applicator brush having a tubular base that forms a proximal end, a brush conduit, and a distal end, the brush conduit being unobstructed and not including a valve;

the disposable applicator brush further including a plurality of bristles adjacent the distal end of the brush conduit;

wherein the tubular base has an external surface that is shaped to removably engage the brush receiver of the dispenser body so that the nail polish from the dispenser conduit flows through the brush conduit, and into the bristles of the disposable applicator brush;

wherein the end of the dispenser conduit engages a conduit receiver formed beneath the brush receiver; and further comprising an O-ring that fits around an outer surface of the dispenser conduit and abuts an inner surface of the conduit receiver so that the dispenser conduit can move up and down in relation to the conduit receiver and the dispenser body, without allowing the nail polish to leak from between the dispenser conduit and the conduit receiver.

2. The combination of claim 1, wherein the mounting structure includes an inwardly projecting annular ring that frictionally engages a rim of the container to removably lock the dispenser body over the container.

3. The combination of claim 1, wherein the brush receiver and the conduit receiver are separated by a separator wall that includes an aperture therethrough for transmitting the nail polish.

4. The combination of claim 1, wherein the dispenser conduit is separated from the valve receiver by a spacer wall that includes a hole therethrough for transmitting the nail polish.

5. The combination of claim 1, further comprising an actuation structure integrally formed with the valve receiver, the actuation structure having an inclined outer surface that is inclined relative to the axis of the valve receiver.

6. The combination of claim 5, wherein the valve actuation mechanism includes at least one button than extends through an opening in the dispenser body and abuts the inclined outer surface such that pressing the button pushes the actuation structure downwardly and actuates the valve.

7. The combination of claim 1, wherein the tubular base of the disposable applicator brush includes a lower annular portion and an upper annular portion, and the upper annular portion has an outer diameter that is larger than an outer diameter of the lower annular portion, and wherein the outer diameter of the upper annular portion of the tubular base is greater than an inner diameter of the brush receiver, so that an end of the brush receiver abuts a step in the tubular base between the lower annular portion and the upper annular portion.

8. A combination dispenser and applicator for dispensing nail polish, the combination comprising:

a container comprising a rigid outer housing, and a flexible bag positioned within an interior chamber of the rigid outer housing, the nail polish being contained within the flexible bag, and the rigid outer housing also containing a pressurized gas so that pressure from the gas is exerted upon the nail polish through the flexible bag;

a valve operably mounted to the flexible bag and extending through the rigid outer housing for selectively releasing the nail polish from the container, under pressure from the pressurized gas, when actuated;

a dispenser body having a mounting structure for mounting the dispenser body over the valve;

a brush receiver that receives the nail polish from the valve of the container;

a disposable applicator brush having a tubular base that forms a proximal end, a brush conduit, and a distal end, the brush conduit being unobstructed and not including a valve;

a plurality of bristles adjacent the distal end of the brush conduit;

the tubular base being shaped to removably engage the brush receiver of the dispenser body so that the nail polish from the valve flows through the brush conduit and into the bristles of the disposable applicator brush;

further comprising a dispenser conduit operably connecting the valve with the brush receiver, and wherein an end of the dispenser conduit engages a conduit receiver formed beneath the brush receiver; and further comprising an O-ring that fits around an outer surface of the dispenser conduit and abuts an inner surface of the conduit receiver so that the dispenser conduit can move up and down in relation to the conduit receiver and the dispenser body, without allowing the nail polish to leak from between the dispenser conduit and the conduit receiver.

9. The combination of claim 8, wherein the brush receiver and the conduit receiver are separated by a separator wall that includes an aperture therethrough for transmitting the nail polish.

10. The combination of claim 8, further comprising a valve receiver shaped to operably engage the valve for receiving the nail polish from the valve, and wherein the dispenser conduit is separated from the valve receiver by a spacer wall that includes a hole therethrough for transmitting the nail polish.

11. The combination of claim 10, wherein an upwardly extending dispensing tube of the valve is shaped to engage the valve receiver and abuts the spacer wall, such that downward pressure on the valve receiver depresses the upwardly extending dispensing tube of the valve and moves the valve to an open position against the bias of a valve spring that biases the valve towards a closed position.

12. The combination of claim 8, further comprising an actuation structure integrally formed with the valve receiver, the actuation structure having an inclined outer surface that is inclined relative to the axis of the valve receiver.

13. The combination of claim 12, wherein the valve actuation mechanism includes at least one button than extends through an opening in the dispenser body and abuts the inclined outer surface such that pressing the button pushes the actuation structure downwardly and actuates the valve.

14. The combination of claim 8, wherein the tubular base of the disposable applicator brush includes a lower annular portion and an upper annular portion, and the upper annular portion has an outer diameter that is larger than an outer diameter of the lower annular portion; and wherein the outer diameter of the upper annular portion of the tubular base is greater than an inner diameter of the brush receiver, so that an end of the brush receiver abuts a step in the tubular base between the lower annular portion and the upper annular portion.

* * * * *